United States Patent [19]

Owen

[11] Patent Number: 4,478,558

[45] Date of Patent: Oct. 23, 1984

[54] DOWNHOLE PUMP WITH CHECK VALVE

[75] Inventor: Douglas B. Owen, Rochester, Mich.

[73] Assignee: D. W. Zimmerman Mfg., Inc., Madison Heights, Mich.

[21] Appl. No.: 392,078

[22] Filed: Jun. 25, 1982

Related U.S. Application Data

[62] Division of Ser. No. 175,281, Aug. 4, 1980, Pat. No. 4,360,320.

[51] Int. Cl.[3] ..... F04B 49/08; F16K 31/12

[52] U.S. Cl. ..... 417/296; 137/508

[58] Field of Search ..... 137/508; 417/296, 478, 417/479, 383, 394

[56] References Cited

U.S. PATENT DOCUMENTS

| | | | |
|---|---|---|---|
| 1,688,237 | 10/1928 | Joncha | 137/508 X |
| 1,943,102 | 1/1934 | Woodruff | 417/296 |
| 2,839,078 | 6/1958 | Lornitzo | 137/508 |
| 3,516,761 | 6/1970 | Scroggins | 417/296 X |
| 4,204,560 | 5/1980 | Erikson | 137/508 |

FOREIGN PATENT DOCUMENTS

| | | | |
|---|---|---|---|
| 572996 | 3/1933 | Fed. Rep. of Germany | 417/121 |

*Primary Examiner*—Richard E. Gluck

*Attorney, Agent, or Firm*—Allen D. Gutchess, Jr.

[57] ABSTRACT

A liquid pump is provided and particularly a downhole pump for use in an oil well bore for pumping oil or in a gas well to remove condensate. The downhole pump includes a plurality of pump and transfer modules, each of which includes an elongate housing with end couplings and with two internal passages extending therethrough. The pump module further has a bladder extending between the end couplings around the internal passages with the couplings having passages connecting one of the internal passages to space on one side of the bladder. When fluid, preferably gas, under pressure is supplied to that passage, the bladder forces liquid therein upwardly into the next module. At the same time, fluid under pressure is exhausted through one of the passages from the space on the opposite side of the bladder of the next pump module, aiding it to receive liquid from the pump module therebelow. The transfer modules supply the liquid up from a lower pump module to an upper one and connect the fluid passages to enable the fluid to operate the bladders. The modules have check valves at the lower ends enabling flow of liquid only in the upward direction. However, the check valves have provisions for being opened when fluid under greater than operating pressure is applied thereto to enable liquid in the modules to drain back down through the pump.

5 Claims, 21 Drawing Figures

DOWNHOLE PUMP WITH CHECK VALVE

This is a division of application Ser. No. 175,281 filed Aug. 4, 1980, now U.S. Pat. No. 4,360,320.

This invention relates to a liquid pump for pumping liquid upwardly in a well.

The new pump includes a plurality of modules, some of which are pump modules for pumping oil upwardly and some are transfer modules for transferring the oil from one pump module to the next. Each of the modules, whether pump or transfer, includes an elongate housing having a lower coupling and an upper coupling. Each module also has two internal passages formed therein extending between the lower and upper couplings. The lower coupling has a passage for supplying oil upwardly into the module and the upper coupling has a passage for receiving oil from the module and supplying it to the next module thereabove. The pump modules also have bladders located around the internal passages and extending between the lower and upper couplings. Each of the pump couplings also has passage means by which fluid under pressure in one of the internal passages can be supplied to the space on one side of the bladder, preferably the outside, between the bladder and the housing. This gas moves the bladder in a manner to force the oil upwardly to the next module. The transfer modules transfer the oil upwardly from a lower pump module to an upper one and also connect the internal passages of the pump modules in a manner to alternate compressing and expanding motions of the bladders of the pump modules.

Each of the modules has a check valve in the passage in the lower coupling. This check valve enables flow of oil only upwardly into the module. However, there also is an annular piston which can be moved when pressure is increased to separate the valve seat from the check valve ball and thereby drain the oil from the module.

In addition to oil wells, the liquid pump can be used to remove condensate from gas wells.

The new pump can employ natural gas under pressure to operate the pump modules so that no external power is necessary, rendering the pumps particularly adaptable for remote locations. The components of the pump and transfer modules are mostly made of reinforced plastic for long life, with metal parts being a minimum. This is particularly true for such oils as sour crude which is high in hydrogen sulphide, rendering it toxic and corrosive. The modules also have relatively few seals and only two seals between moving parts. The new pump also is expected to have lower operating and maintenance costs than sucker rod pumps.

It is, therefore, a principal object of the invention to provide an improved liquid pump having the advantages and features discussed above.

Many other objects and advantages of the invention will be apparent from the following detailed description of a preferred embodiment thereof, reference being made to the accompanying drawings, in which.

Figure 3:
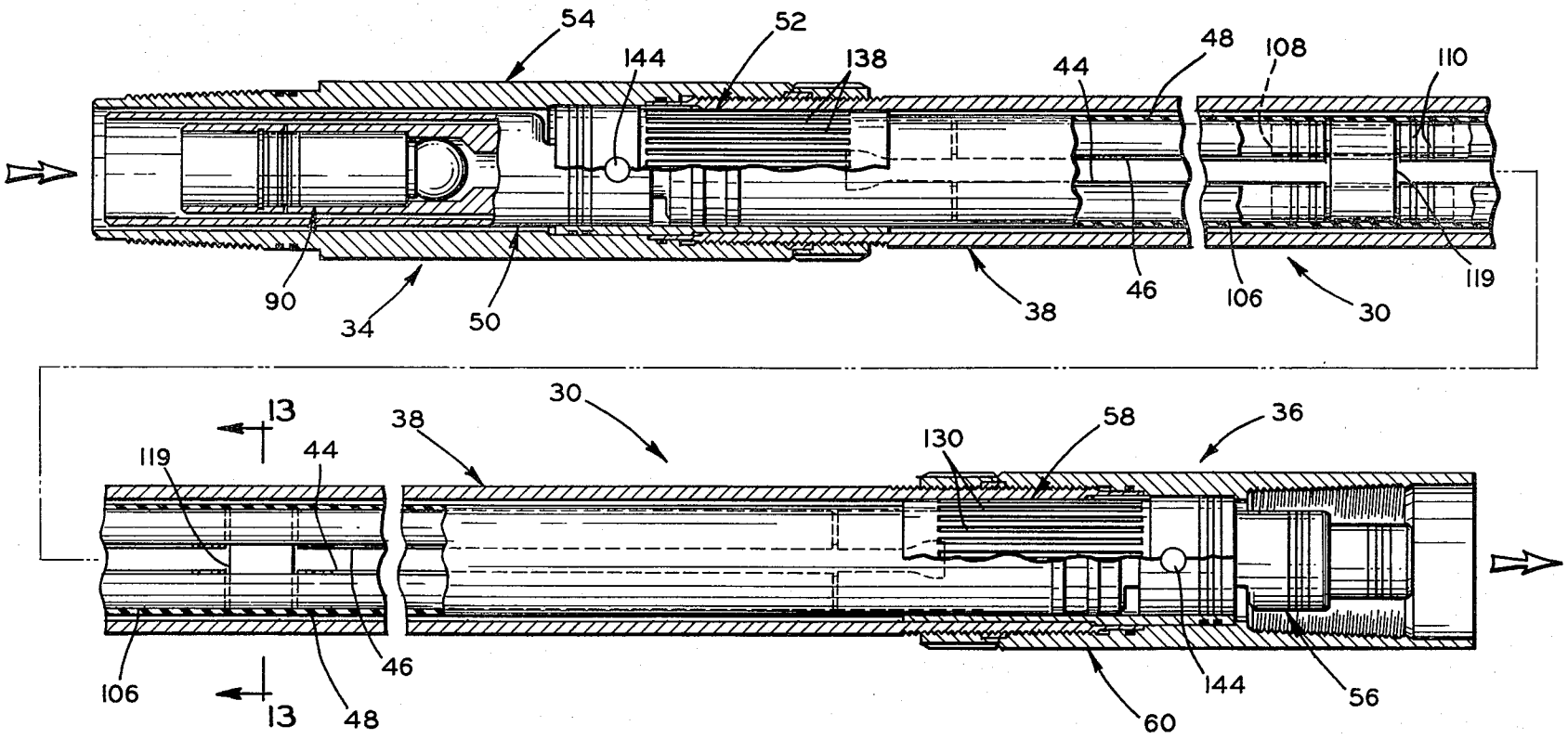
FIG. 3 is an enlarged, framentary view of the pump module of FIG. 2, with parts broken away and with parts in section.
Figure 4:
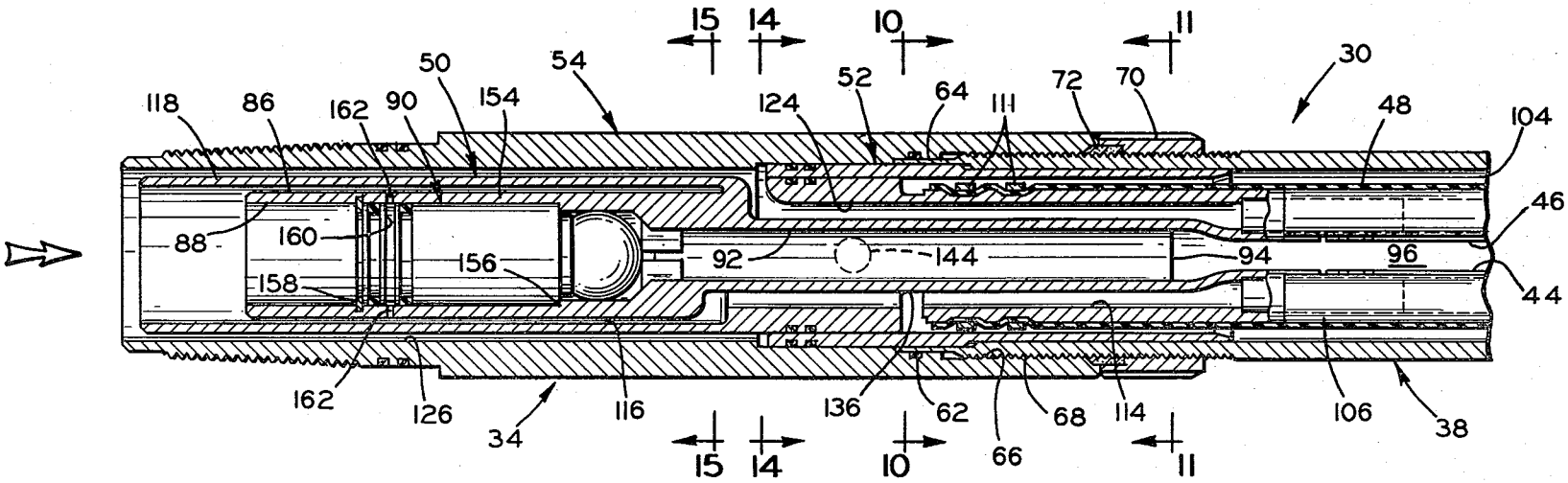
FIG. 4 is a further enlarged view in longitudinal cross section of the lower or left end of the pump module as shown in FIG. 3.
Figure 5:
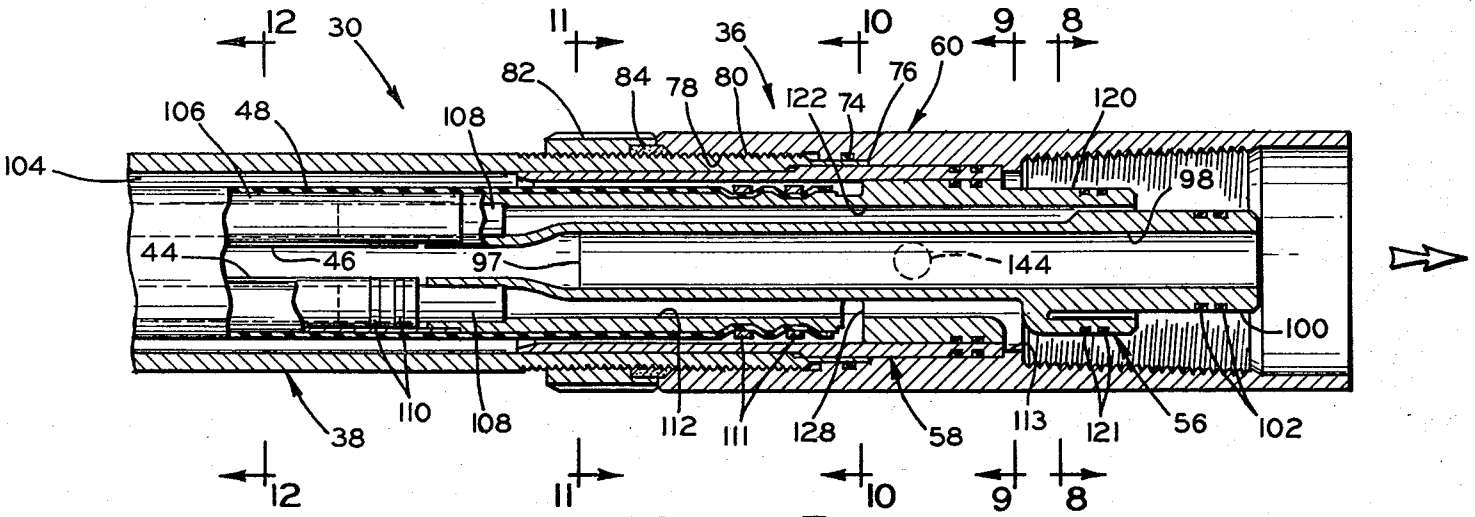
FIG. 5 is a further enlarged view in longitudinal cross section of the upper or right end of the pump module as shown in FIG. 3.
Figure 6:
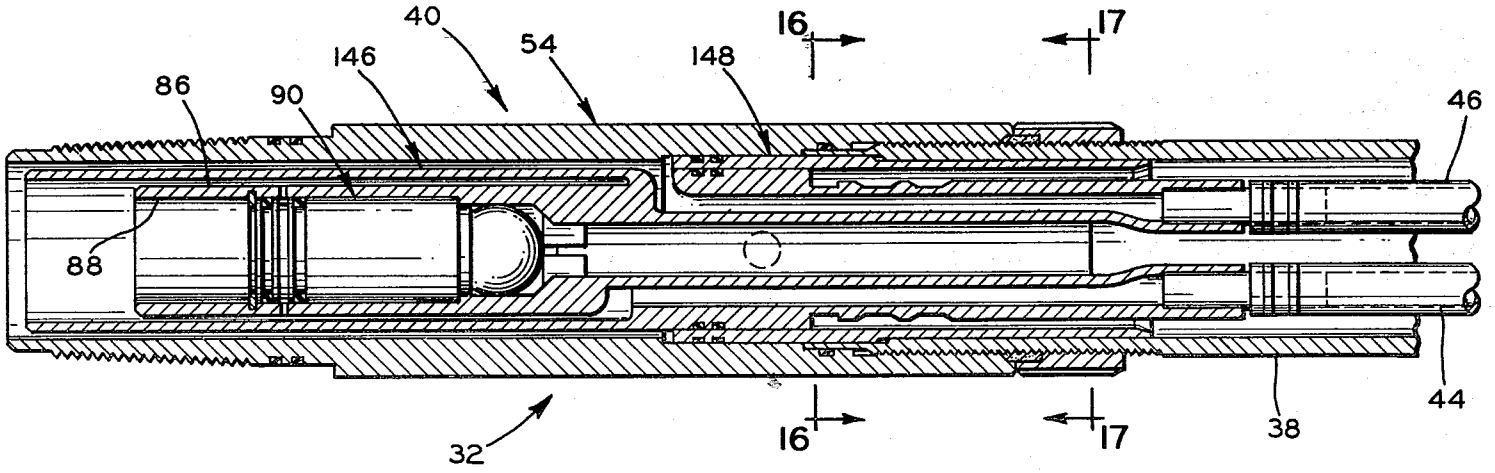
FIG. 6 is an enlarged view in longitudinal cross section of the lower end of the transfer module of FIG. 2.
Figure 7:
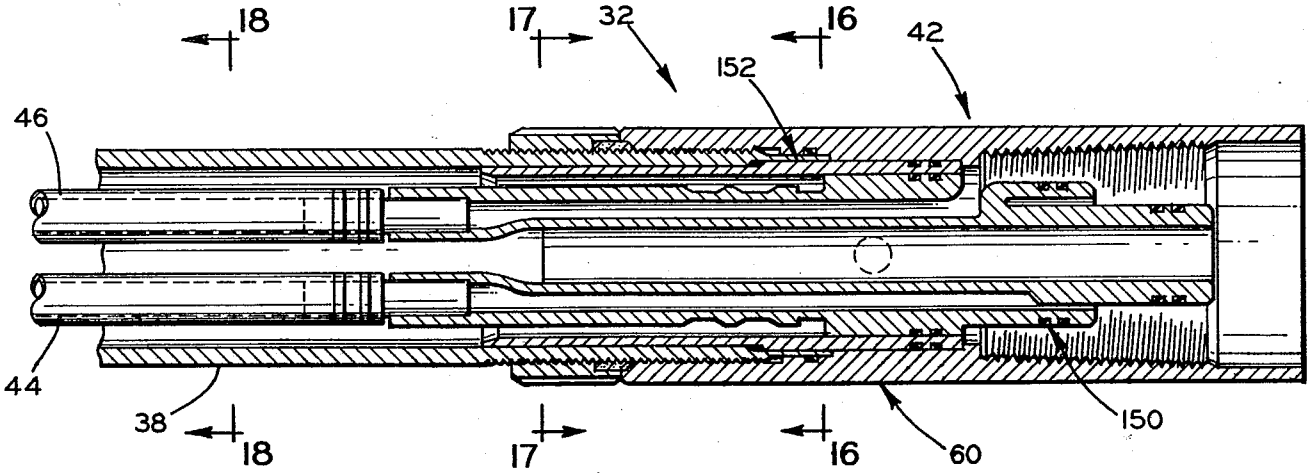
FIG. 7 is an enlarged view in longitudinal cross section of the upper end of the transfer module of FIG. 2.
Figure 8:
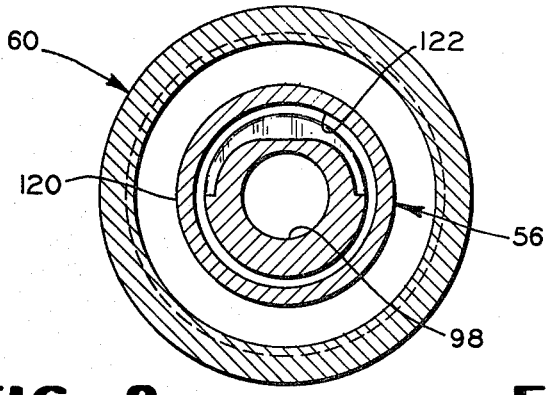
Figure 9:
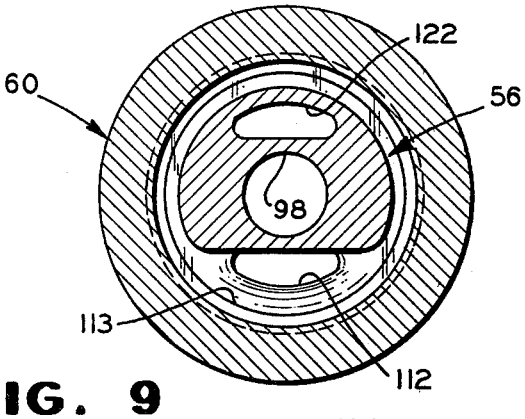
Figure 10:
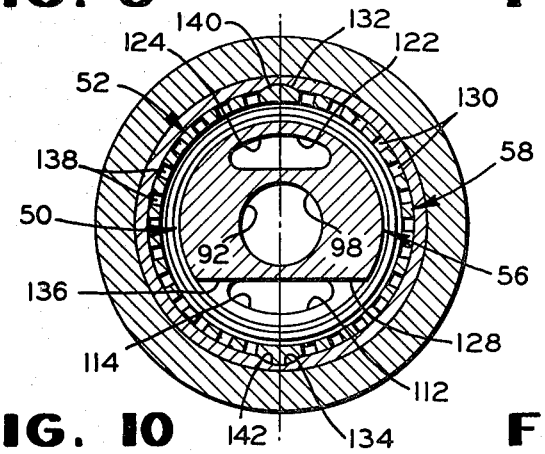
Figure 11:
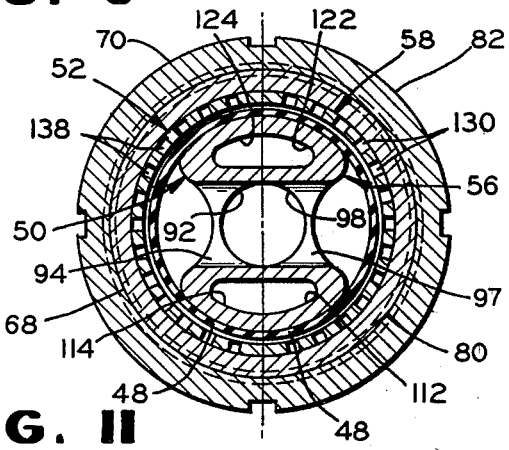
Figure 12:
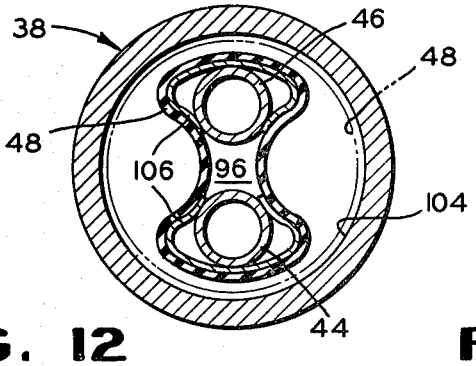
Figure 13:
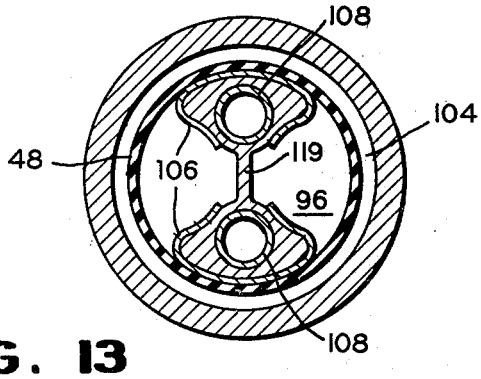
Figure 14:
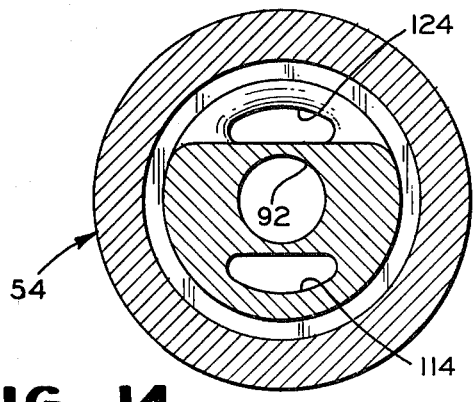
Figure 15:
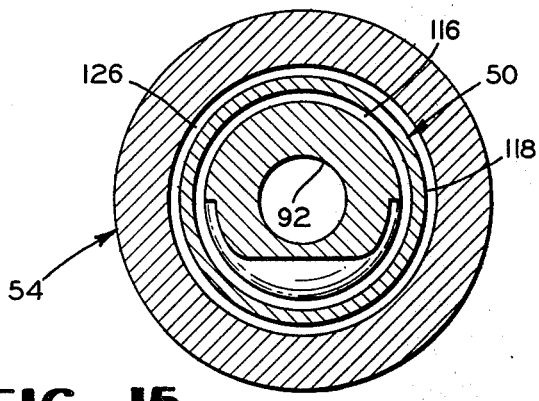
Figure 16:
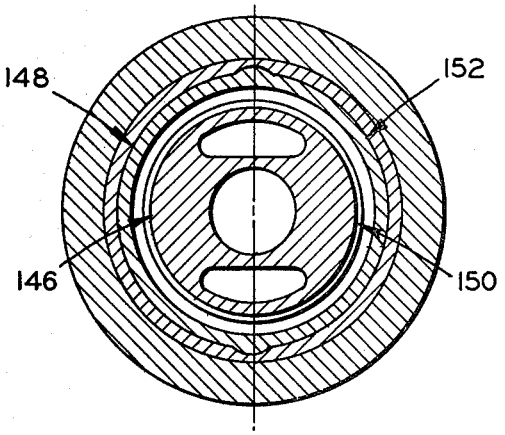
Figure 17:
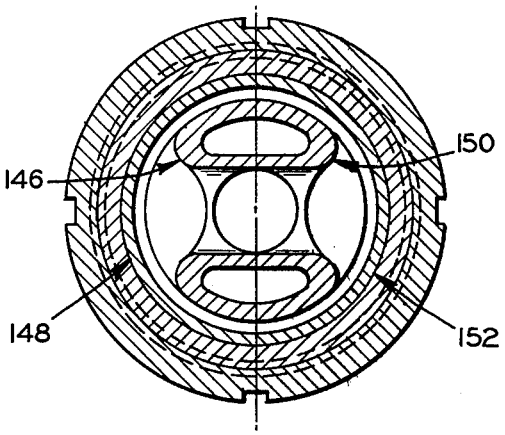
Figure 18:
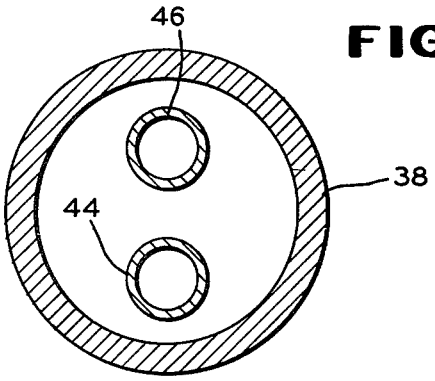
Figure 19:
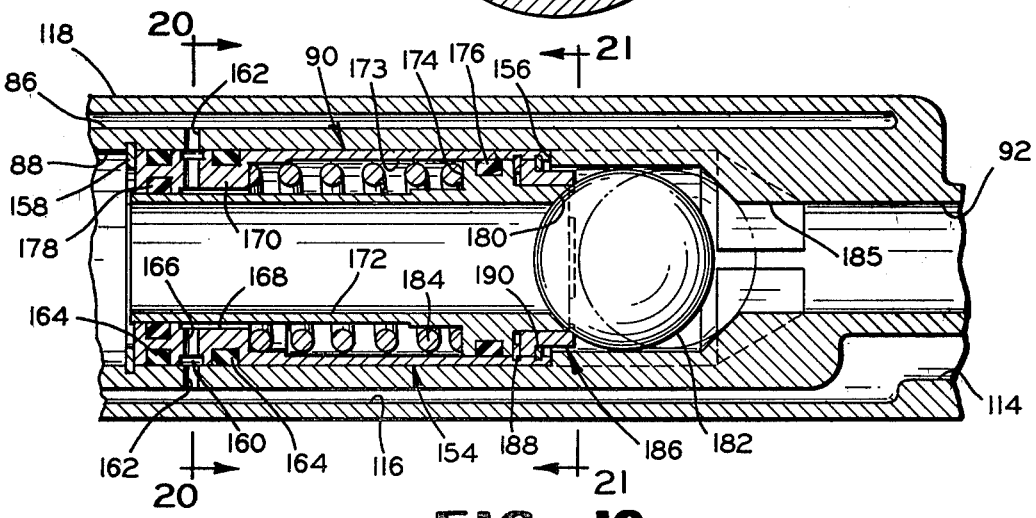
Figure 20:
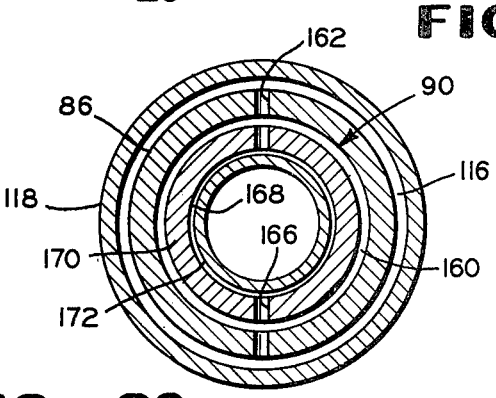
Figure 21:
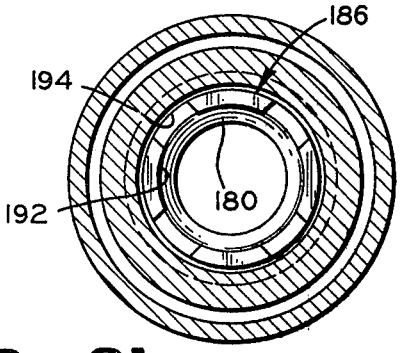

FIGS. 8 and 9 are enlarged views in transverse cross section taken along the lines 8—8 and 9—9 of FIG. 5;

FIGS. 10 and 11 are enlarged views in transverse cross section taken along the lines 10—10 and 11—11 of FIGS. 4 and 5;

FIG. 12 is an enlarged view in transverse cross section taken along the line 12—12 of FIG. 5, but with a bladder component shown in a different position;

FIG. 13 is an enlarged view in transverse cross section taken along the line 13—13 of FIG. 3;

FIGS. 14 and 15 are enlarged views in transverse cross section taken along the lines 14—14 and 15—15 of FIG. 4;

FIGS. 16 and 17 are enlarged views in transverse cross section taken along the lines 16—16 and 17—17 of FIGS. 6 and 7;

FIG. 18 is an enlarged view in transverse cross section taken along the line 18—18 of FIG. 7;

FIG. 19 is an enlarged, fragmentary view in longitudinal cross section taken through a check valve used with the pump and transfer modules;

FIG. 20 is a view in transverse cross section taken along the line 20—20 of FIG. 19; and FIG. 21 is a view in transverse cross section taken along the line 21—21 of FIG. 19, with a valve ball omitted.

Figure 1:
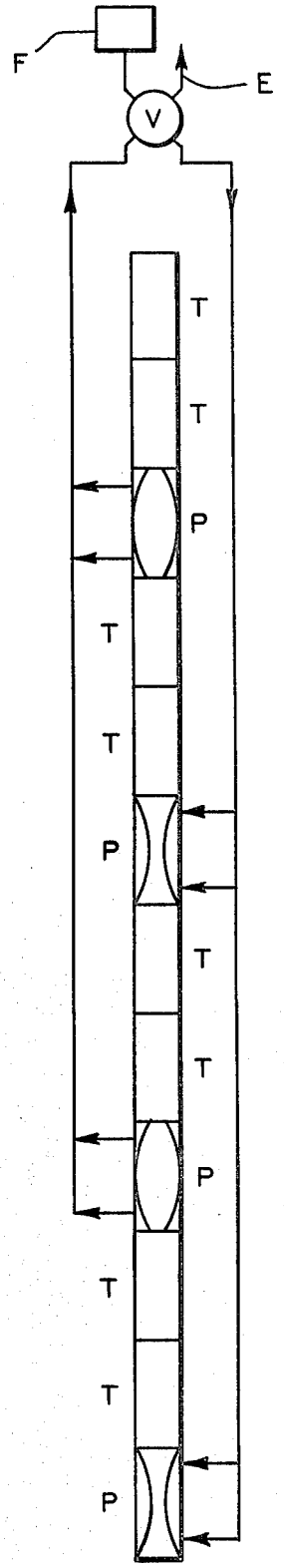
FIG. 1 is a diagrammatic view of a downhole pump according to the invention, including a plurality of pump modules and transfer modules.

The overall downhole pump in accordance with the invention is shown in FIG. 1. Pump modules which pump the oil or other liquid upwardly are designated "P" and transfer modules located between the pump modules and connecting them are designated "T". Fluid, preferably gas, under pressure is supplied to the pump modules "P", preferably to both ends thereof through two fluid lines, and the pump modules are also preferably exhausted at both ends through the fluid lines. For this purpose, a source of fluid under pressure is designated "F" above the surface of the ground and an exhaust vent "E" is also located above the surface, with the fluid and the exhaust vent "E" connected with the lines through a valve "V". When fluid under pressure is supplied to the pump modules, flexible tubular members or bladders represented by the curved lines in the pump modules are compressed inwardly or squeezed to force oil therein upwardly to the next transfer module "T". When the gas is exhausted from the pump modules "P", the bladders expand to receive oil from the lower transfer module "T" which is being pumped upwardly by the next lower pump module "P".

The number of the transfer modules employed can vary from zero to about five. When no transfer modules are employed, the head against which the pump must pump is equal to the length of two of the pump modules "P". When one transfer module is added, the head is equal to the length of the two pump modules plus the length of the transfer module. Although the higher head results in more pressure against which the pump must work, the use of fewer pump modules and more transfer modules is advantageous because the transfer modules do not employ the bladders which add to the cost and also maintenance. With the pump and transfer modules typically being thirty feet long, with one pump and four transfer modules, a head of 180 feet results.

The modules are made mostly of reinforced plastic materials which can withstand the attack of various chemicals and render the pump particularly suitable for pumping sour crude oil. By way of example, the pump is designed to be used to depths up to 5000 feet with a delivery rate of 100 barrels of liquid per day. The pump is also designed to operate at 100 PSI fluid pressure with a maximum bottom hole temperature of 170 degrees F. A check valve is employed to drain the oil, which will be discussed later, and is designed to be fully open at 145 PSI.

Figure 2:
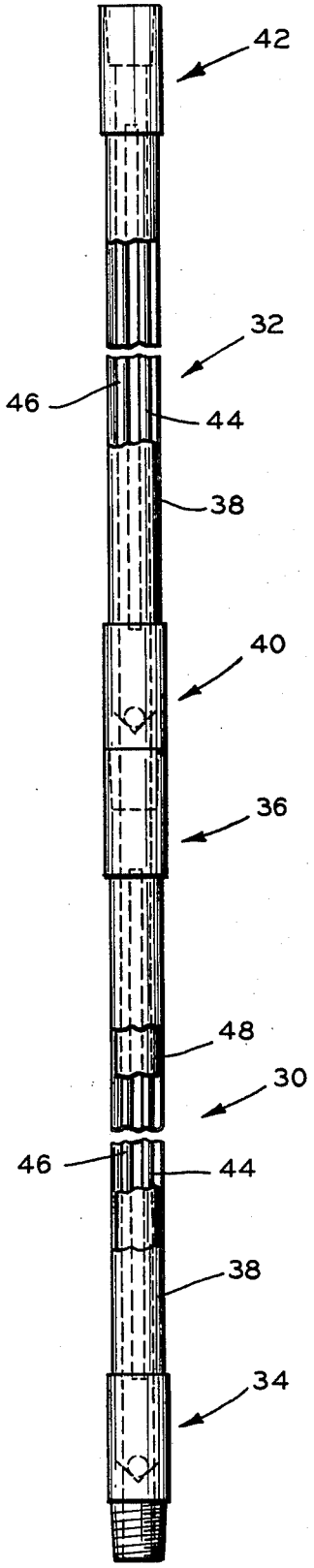
FIG. 2 is a schematic view, with parts broken away, of a pump modules and a transfer module of FIG. 1.

Referring to FIG. 2, a pump module 30 and a transfer module 32 are shown schematically in assembled relationship. The pump module 30 has a lower coupling 34 and an upper coupling 36 with a tubular housing 38 extending therebetween. The transfer module 32 has a lower coupling 40 and an upper coupling 42 with the tubular housing 38 extending therebetween. The couplings are connected by tapered threads and require no orientation when assembled. Each of the modules has a first internal tube 44 extending between the couplings and forming a first passage therebetween. Each of the modules also has a second internal tube 46 extending between the couplings and forming a second passage therebetween. The couplings of the two modules are slightly different, which is the reason for different reference numerals. The pump module 30 also differs from the transfer module 32 in that it has a flexible member or bladder 48 of simple tubular shape extending between the couplings 34 and 36 around the passage tubes 44 and 46.

Referring to FIGS. 3–5, the lower coupling 34 of the pump module 30 comprises three components, all of which preferably are made of reinforced plastic material. These include a central core 50, a sleeve 52 surrounding part of the core, and an outer, threaded connector 54. Similarly, the upper coupling 36 has three components preferably of reinforced plastic material. These include a central core 56, a sleeve 58 surrounding part of the core, and an outer, threaded connector 60. The connector 54 has a seal 62 which seals with an extremity 64 of the housing 38 and has a threaded recess 66 into which a threaded end 68 of the housing 38 is threaded. A lock nut 70 and a sealing ring 72 complete the connection between the connector 54 and the housing 38. Similarly, the upper connector 60 of the coupling 36 has a seal 74 which seals with an upper end extremity 76 of the housing 38 and has a threaded recess 78 into which a threaded end 80 of the housing 38 is threaded. A lock nut 82 and a sealing ring 84 complete the upper connection between the housing 38 and the connector 60.

Oil or other liquid is supplied to the pump module 30 through the lower coupling 34. The oil is then forced upwardly by the bladder 48 through the upper coupling 36 and into the next module. To supply the oil, the core 50 and a tubular projection 86 extending downwardly and forming a central oil passage 88 in which is a check valve 90. In its normal operation, the check valve 90 enables flow of oil into the module 30 through the passage 88 but prevents oil from flowing in the opposite direction. The core 50 also has a smaller central passage 92 terminating at a notch 94. From here the oil flows into a space 96 within the bladder 48 causing the bladder to expand outwardly to the wall of the housing 38. When the bladder is squeezed inwardly to reduce the space 96, the oil is forced upwardly through a notch 97 in the upper core 56 similar to the notch 94, and then through a central oil passage 98 terminating in a tubular projection 100 having seals 102.

Fluid, preferably gas, under pressure is supplied to a space 104 around the bladder 48 and, specifically, between the bladder 48 and the housing 38. This squeezes the bladder 48 inwardly around the tubes 44 and 46 and around guides 106 placed thereon. The guides 106 preferably are located along the entire length of the tubes 44 and 46. The bladder 48 thereby assumes a generally hourglass shape, as shown in FIG. 12. The space 96 is accordingly reduced considerably and the outer space 104 expanded. More specifically, the volume of the space 96 can be reduced about 90 percent, thus forcing a corresponding volume of oil upwardly into the next module. If four tubes are employed instead of two, the bladder 48 will assume a generally cloverleaf shape when compressed or squeezed. When compressed, the bladder shape is such that its circumference is substantially the same as when it is in its normal state, resulting in no stretch. When expanded, the bladder is only stretched circumferentially about eleven percent, with no significant axial stretch.

The gas is alternately supplied under pressure to the space 104 outside the bladder 48 and exhausted therefrom through the internal passages formed by the tubes 44 and 46. These are alternately connected to the source "F" of gas under pressure and the exhaust vent "E" through the valve "V" of FIG. 1. The tubes 44 and 46 can be extruded plastic in the pump module 30. At the ends, they are affixed to metal nipples 108 which can be molded into the cores 50 and 56 with the tubes affixed securely by metal bands 110 which are shrunk onto the tubes by a commercially-available process using an electromagnetic metal-forming technique. The bladder 48 can also be connected to the cores 50 and 56 by similar, but larger, metal bands 111.

Gas is supplied to the first tube 44 through a passage 112 (FIGS. 5 and 9–11) formed in the body of the core 56 which communicates with annular passage 113. At the lower end, the tube 44 communicates with a passage 114 in the core 50 which communicates with an annular passage 116 formed between the tubular projection 86 of the core 50 and an outer tubular projection 118 of the core.

To prevent undue deflection of the tubes 44 and 46, a plastic web support 119 (FIGS. 3 and 13) can be employed at the center of the housing, and preferably at several points therealong. Where the web support is employed, the metal nipples 108 can be used therein to connect separate tubes on each side of the support. However, some deflection of the tubes 44 and 46 in the pump module 30 is desirable since this results in a partial vacuum and enables the oil to be pumped at lower inlet heads.

Gas for the tube 46 is supplied around the projection 100 of the core 56 and through an outer tubular projection 120 having double seals 121 to a core passage 122 which communicates with the tube 46. The lower end of the tube 46 communicates with a passage 124 in the core 50, which communicates with an annular passage 126 formed around the tubular projection 118, between it and the inner surface of the connector 54. Other double seals, shown but not numbered, are employed between various components to prevent leakage, the double seals also providing a long service life.

If two of the pump modules are connected together, the gas from the passage 126 of the lower coupling of the upper module is then received in the passage 112 of the upper core 56 of the lower pump module and, hence, supplied to the tube 44 of that module. Similarly, gas supplied through the annular passage 116 around the tubular projection 86 of the lower core 50 of the upper module is supplied through the passage 122 of the upper core 56 of the lower pump module and, hence, to the tube 46. It will thus be seen that the first tube 44 of the upper pump module communicates with the second tube 46 of the lower pump module and the second tube 46 of the upper pump module communicates with the first tube 44 of the lower pump module when they are connected. As will be subsequently discussed, the same alternate communication can occur between adjacent pump modules when separated by transfer modules.

To supply gas under pressure to the space 104 around the bladder 48 from the first tube 44 and the passage 112, the core 56 has a transverse notch or opening 128 therein which communicates with the passage 112 and with the inner surface of the sleeve 58. The sleeve 58 also has a plurality of longitudinally-extending slots 130 (FIG. 3) which extend from the notch 128 to a point beyond the notch 97 in the core 56 at the end of the passage 98. This assures free passage of the gas even if there is a rather snug fit between the bladder 48 and the inner surface of the sleeve 58. Thus, when gas under pressure is supplied through the opening 128, it can flow through the slots 130 into the space 104 around the bladder to cause the bladder to be squeezed and contract. When gas is exhausted from the passage 112, the gas in the space 104 can flow back through the slots 130 to enable the bladder to expand out of the inner surface of the housing 38. The sleeve 58 also has diametrically opposite ridges 132 (FIG. 10) which cooperate with grooves 134 in the extremity 76 of the housing 38 to orient the sleeve 58 relative to the housing.

Similarly, at the coupling 34, a notch or opening 136 is formed in the core 50 to communicate with the passage 114 and the inner surface of the sleeve 52. The sleeve 52 also has longitudinally extending slots 138 which are similar to the slots 130 and serve the same purpose. The sleeve 52 also has ridges 140 cooperating with grooves 142 in the lower extremity 64 of the housing 38 to orient the sleeve 52 relative to the housing. The sleeves 52 and 58 are then connected with the cores 50 and 56 through dowel pins 144. Thus, the cores, sleeves, and housing are all oriented to prevent twisting, especially when the couplings are screwed together. Twisting could be particularly deleterious to the operation of the bladder 48.

While it is only necessary to have the opening 128 in the core 56, the use of both of the openings 128 and 136 enables quicker response when gas is supplied through the tubes 44 and 46 or is exhausted therefrom, and also permits gas condensate to drain from the space 104. By way of example, one cycle of supplying gas under pressure and exhausting it will consume about a minute. However, this will vary, depending upon the depth of the well and the number of pump modules employed as well as the pressures involved. When natural gas is used for the pressurizing gas, preferably it is first dried before being supplied to the lines. In any event, a device can be employed near the bottom of the bottom module to enable the lines to be blown out, this being in the nature of a dump valve or relief valve.

When both of the openings 128 and 136 are used and the bladder expands, it fills from the bottom, resulting in an upwardly moving bladder "wave" as it expands outwardly to the outer tube wall. Gas then is exhausted primarily through the opening 128 in the core 56. When the bladder 48 compresses during pumping, it starts from the top, because of higher oil pressure at the bottom, resulting in a downwardly moving bladder "wave", with the pressurized gas flowing primarily through the upper opening 128. During compression, consequently, the oil is forced to flow through a compressed area of the bladder. If bladder compression began at the bottom, this restriction could be eliminated, or at least reduced. This could be accomplished by employing a check valve in the upper opening 128, enabling gas to be exhausted but not supplied therethrough. Pressurized gas would then be supplied only through the lower opening 136 in the core 50.

The transfer module 32 of FIGS. 6 and 7 will now be discussed. The transfer module is employed only to transfer oil up toward the upper pump module 30 and to supply gas to and exhaust gas from the lower pump module. The transfer module 32 differs basically from the pump module 30 in that no bladder is employed. Consequently, no other core notches or openings are employed and the sleeves do not require slots, although the same sleeves can be used as are employed with the pump module to reduce the number of different components required. The lower coupling 40 of the transfer module 32 has a core 146 which differs from the core 50 of the pump module only in that the notch or opening 136 is not employed. The coupling also includes a sleeve 148 which differs from the sleeve 52 only in that the slots 138 need not be used. The coupling 40 also includes the connector 54 which is the same as that of the pump module. The upper coupling 42 of the transfer module includes a core 150 which differs from the core 56 in that the notch or opening is not employed. The core 150 is also turned 180° from the core 56, in this instance. The coupling 42 also includes a sleeve 152 which is the same as the sleeve 58 except that the slots 130 need not be used. Finally, the coupling 42 includes the connector 60 which is the same as that of the pump module.

The cross-sectional views of FIGS. 16 and 17 show the transfer module with the modified sleeves and cores. Without the bladder, the entire cross section of the housing 38 of FIG. 18 is filled with oil except for the tubes 44 and 46.

The pump modules 30 should be connected in a manner such that the gas tube 44 of the upper pump module communicates with the gas tube 46 of the next lower pump module and vice versa. This enables the bladder 48 of the upper module to expand as the bladder 48 of the lower module is being squeezed, and vice versa. The transfer module 32, as shown in FIGS. 6 and 7, is assembled so that the gas tube 44 therein communicates with the gas tube 44 of the pump module above and the gas tube 46 of the pump module below and vice versa. With this arrangement, the same gas tubes of two adjacent transfer modules will communicate with one another and provide a straight flow therethrough. Any number of transfer modules can be employed. Again, it is only important that the transfer modules be arranged so that alternate gas passages of the adjacent or closest pump modules will be in communication with one another.

The check valve 90 is shown in more detail in FIGS. 19, 20, and 21. The check valve 90 is used at the lower end of each of the modules 30 and 32 to enable oil to flow upwardly but prevent it from draining back downwardly, Although conventional check valves can be used in these locations, the check valve 90 has a particular advantage. When the modules are used to pump sour crude oil, in particular, it is extremely unpleasant to handle. If conventional check valves are used, when the pumping string is pulled for servicing or for any other reason, the modules will be full of the sour crude which must somehow be disposed of when the modules are raised. However, the check valve 90 is designed so that it can be opened by employing gas under higher pressure to open the check valve and to drain the oil, when desired. The check valve also enables the injection of fluids under higher pressure to remove possible paraffin accumulation in the modules or into the production zone, if desired.

Referring to FIGS. 19–21, the check valve 90 is located in the lower central oil passage 88 of the core 50 or 146. The valve includes an outer housing 154 positioned in the passage 88 by a shoulder 156 and a split ring 158. An annular groove 160 of the housing 154 communicates with openings 162 in the wall of the tubular projection 86. The openings 162 communicate with the passages 116 and 114, the latter communicating with the notch 136 in the core 50 and with the passage formed by the first tube 44. It is important that the annular groove 160 communicates with the same passages that supply the gas under pressure to the bladder 48. Seals 164 are located on each side of the annular groove 160 which communicates with openings 166 in the housing 154 and with an annular passageway 168 which is formed between an inner surface of an annular ridge 170 of the housing and an outer surface of a piston sleeve 172. Gas under pressure from the passage formed by the tube 44 thus communicates with an annular cylinder 173 formed between the housing and the sleeve. This gas acts upon an annular face of an annular piston 174 formed at one end of the sleeve 172. The piston has a seal 176 engaging the inner surface of the housing 154 and the rear portion of the housing 154 has a seal 178 engaging the outer surface of the piston sleeve 172. The seals 176 and 178 are the only moving seals employed in the entire downhole pump.

The piston sleeve 172 extends beyond the piston 174 and forms an annular check valve seal 180 which cooperates with a check valve ball 182. A coil spring 184 in the annular cylinder 173 acts upon the piston 174 to urge the valve seal 180 toward the ball 182. The ball is limited in the extent it can move away from the valve seat 180 by a plurality of fingers 185 preferably integrally formed in the core 50 or 146 and serving as a cage for the check valve. When the valve ball 182 is in contact with the fingers 185, oil can readily flow thereby through the passages 88 and 92.

A valve ball stop 186 is carried by the housing 90 between split rings 188 and 190. As shown in FIG. 21, the ball stop 186 includes a plurality of arcuate edges 192 and a plurality of notches 194 which provide passages or openings when the valve ball 182 is in contact with the edges 192 and the valve seat 180 is spaced from the ball.

In the operation of the check valve 90, assume that the bladder 48 of the next lower pumping module has been compressed and that the end of the compression cycle has been reached. At that time, the bladder 48 just above the check valve 90 will be expanded and at the end of the expansion cycle. The valve ball 182 is against the valve seat 180 with the seat being urged toward the ball by the spring 184. The oil above the ball is thus prevented from draining down. When gas is supplied under pressure to the outside of the bladder 48 above the check valve, that pressure will also be supplied to the annular cylinder 173 through the passages 114 and 116, the openings 162, the annular groove 160, the openings 166, and the annular passage 168. This gas pressure supplements the force of the spring 184 to hold the valve seat 180 in its upper position with the piston 174 adjacent the split ring 188 to maintain the valve closed even though the pressure of the oil in the passage 92 above the ball increases.

As the next lower bladder starts the compression cycle and is squeezed again, the valve ball 182 is forced off the valve seat 180 and the oil flows upwardly again. At this time, the pressure of the oil flowing upwardly through the check valve also acts downwardly on the valve seat 180 and the annular piston 176 and may move the valve seat downwardly temporarily. However, this does not constitute a problem. If the check valve should fail to function properly, the corresponding valve in the transfer module located below the pump module will permit continuation of the pumping action.

When it is desired to open the check valve 90 to drain the oil from the oil passages in the modules, both of the gas tubes 44 and 46 through the modules are exhausted so that the pressure in the annular cylinder 173 is low in each of the check valves. Gas at a pressure above pump operating pressure is then applied downwardly on the oil at the top of the pump. For example, with operating pressures of around 100 PSI, a pressure of 145 PSI can be applied at the top to the oil to cause the check valve to open. This increased pressure acting downwardly moves the piston 174 and the valve seat 180 downwardly along with the ball 182 until the ball engages the arcuate edges 192 of the ball stop 186. The gas pressure then causes the piston 174 to move further downwardly to unseat and separate the ball seat 180 from the ball 182. Flow of the oil down the passages 92 and 88 then occurs with the oil flowing through the arcuate notches 194 between the stop 186 and the ball 182.

If the pumping string is being removed, the source of gas under pressure is disconnected after draining. When the lower end of the bottom module is above the oil level in the well bore, the gas source can then be connected again to open the check valves again to complete drainage of the lower portions of the pumping string.

Various modifications of the above described embodiments of the invention will be apparent to those skilled in the art, and it is to be understood that such modifications can be made without departing from the scope of the invention if they are within the spirit and the tenor of the accompanying claims.

I claim:

1. A downhole pump for pumping oil out of an oil well, said pump comprising a plurality of pump modules, a plurality of transfer modules between said pump modules, means for supplying fluid under operating pressure to oil in said pump modules for urging the oil upwardly; a check valve in each of said pump modules and said transfer modules, each of said check valves having a valve seat and a valve ball with said valve ball normally seating against said seat to prevent the flow of oil downwardly, each of said check valves having piston means for separating said valve ball and said valve seat when fluid under high pressure above operating pressure is applied to said check valve, to enable the oil to drain downwardly through said pump and said transfer modules, and means for applying fluid under operating pressure to said piston means to urge said piston means toward said valve ball.

2. A downhole pump according to claim 1 characterized by said piston means moving said check valve seat in a direction away from said valve ball.

3. A downhole pump according to claim 2 characterized by each of said check valves having a stop for limiting movement of the valve ball in a direction toward the valve seat.

4. A downhole pump according to claim 3 characterized by said check valve stop comprising an annular sleeve around said valve seat.

5. A downhole pump for pumping oil out of an oil well, said pump comprising a pump module, means for supplying fluid under operating pressure to oil in said module for urging the oil upwardly, a check valve in said pump module, said check valve having a valve seat and a valve ball with said valve ball normally seating against said seat to prevent the flow of oil downwardly, said check valve having a passage above said ball and a passage below said ball for the flow of oil upwardly through said check valve during normal operation of said pump, said check valve having a piston means associated with said valve seat for separating said valve seat from said valve ball when fluid under higher pressure above operating pressure is applied to said check valve, to enable the oil to drain downwardly through said passages, said check valve having a separate chamber from said passages for applying fluid under operating pressure to said piston means on a side opposite said valve ball to urge said piston means toward said valve ball, and means for supplying fluid under operating pressure to said chamber.

* * * * *

UNITED STATES PATENT OFFICE

CERTIFICATE OF CORRECTION

PATENT NO. : 4,478,558

DATED : October 23, 1984

INVENTOR(S) : Douglas B. Owen

It is certified that error appears in the above-identified patent and that said Letters Patent are hereby corrected as shown below:

Column 9, line 1, "high" should be --higher--.

Signed and Sealed this

*Twelfth* Day of *March 1985*

[SEAL]

*Attest:*

DONALD J. QUIGG

*Attesting Officer* *Acting Commissioner of Patents and Trademarks*